US009519270B2

(12) United States Patent
Villar

(10) Patent No.: US 9,519,270 B2
(45) Date of Patent: Dec. 13, 2016

(54) POWER RESERVE INDICATOR FOR A TIMEPIECE

(71) Applicant: ETA SA Manufacture Horlogere Suisse, Grenchen (CH)

(72) Inventor: Ivan Villar, Bruegg (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/797,383

(22) Filed: Jul. 13, 2015

(65) Prior Publication Data

US 2016/0018787 A1 Jan. 21, 2016

(30) Foreign Application Priority Data

Jul. 21, 2014 (EP) ..... 14177775

(51) Int. Cl.

| | |
|---|---|
| ***G04B 1/10*** | (2006.01) |
| ***G04B 3/00*** | (2006.01) |
| ***G04B 1/00*** | (2006.01) |
| ***G04B 9/00*** | (2006.01) |
| ***G04B 1/12*** | (2006.01) |

(52) U.S. Cl.

CPC . *G04B 1/00* (2013.01); *G04B 1/12* (2013.01); *G04B 3/008* (2013.01); *G04B 9/00* (2013.01); *G04B 9/005* (2013.01)

(58) Field of Classification Search

CPC ..... G04B 1/12; G04B 9/00; G04B 9/02; G04B 9/005; G04B 3/008

USPC ..... 368/140, 210

See application file for complete search history.

(56) References Cited

U.S. PATENT DOCUMENTS

| | | | | |
|---|---|---|---|---|
| 2,698,066 A * | 12/1954 | Favret | ..... | G04B 9/00 368/66 |
| 5,828,628 A * | 10/1998 | Born | ..... | G04B 9/005 368/140 |
| 6,340,241 B2 * | 1/2002 | Jeanneret | ..... | G04B 9/005 368/210 |
| 6,685,352 B1 * | 2/2004 | Capt | ..... | G04B 9/005 368/210 |
| 2007/0041277 A1 * | 2/2007 | Gerber | ..... | G04B 1/12 368/210 |

(Continued)

FOREIGN PATENT DOCUMENTS

| | | | | |
|---|---|---|---|---|
| CH | 694 411 A5 | 12/2004 | | |
| DE | 1158004 B * | 11/1963 | ..... | G04B 1/12 |

(Continued)

OTHER PUBLICATIONS

European Search Report issued Jun. 11, 2015 in European Application 14177775, filed on Jul. 21, 2014 (with English Translation).

*Primary Examiner* — Vit W Miska
*Assistant Examiner* — Daniel Wicklund
(74) *Attorney, Agent, or Firm* — Oblon, McClelland, Maier & Neustadt, L.L.P.

(57) ABSTRACT

Timepiece power reserve indicator for the display of the power reserve indication of a plurality of energy accumulators each including one indicator cooperating with one accumulator input of a differential mechanism comprised in the power reserve indicator, and wherein one output of the differential mechanism cooperates with a mechanism for the display of the total power reserve of the plurality of energy accumulators, and at least two of the inputs are coaxial.

6 Claims, 1 Drawing Sheet

(56) References Cited

U.S. PATENT DOCUMENTS

| | | | | |
|---|---|---|---|---|
| 2007/0091728 | A1 | 4/2007 | Girardin et al. | |
| 2008/0144447 | A1* | 6/2008 | Ruchonnet | G04B 17/285 368/127 |
| 2009/0161495 | A1* | 6/2009 | Jeanneret | G04B 9/005 368/140 |
| 2010/0322036 | A1* | 12/2010 | Crettex | G04B 9/005 368/80 |

FOREIGN PATENT DOCUMENTS

| | | | | |
|---|---|---|---|---|
| EP | 1 582 943 | A1 | 10/2005 | |
| GB | FR 395309 | A * | 0/1909 | G04B 1/12 |

* cited by examiner

POWER RESERVE INDICATOR FOR A TIMEPIECE

This application claims priority from European Patent Application No, 14177775.5 filed Jul. 21, 2014, the entire disclosure of which is hereby incorporated herein by reference.

FIELD OF THE INVENTION

The invention concerns a timepiece power reserve indicator for the display of the power reserve indication of a plurality of energy accumulators, each including one indicator cooperating with one differential input of a differential mechanism comprised in said power reserve indicator, and wherein one output of said differential mechanism cooperates with a mechanism for the display of the total power reserve of said plurality of energy accumulators.

The invention also concerns a timepiece movement including at least one such power reserve indicator.

The invention also concerns a timepiece including at least one such power reserve indicator The invention concerns the field of timepiece display mechanisms.

BACKGROUND OF THE INVENTION

The power reserve indicator of a timepiece mechanism or movement becomes complicated when several energy accumulators are arranged to deliver their energy to the mechanism or to the movement.

In particular, in order to obtain an increased power reserve, several accumulators can be arranged in series, notably barrels. It is possible to view the overall power reserve by using a differential mechanism, including one input per accumulator or barrel. For example, in the case of two barrels mounted in series, the power reserve indication requires a first input for the first barrel (winding) and a second input on the second barrel (letting down). This differential mechanism with separate inputs occupies a large volume within the timepiece movement, which often makes it impossible to provide a timepiece with both, on the one hand, several accumulators and a differential display, and on the other hand, other complications.

EP Patent No 1582943 in the name of RICHEMONT discloses a timepiece movement provided with at least three barrels all housed between a base plate and a bar, said base plate and the bar configured to carry two superposed barrels, and the third barrel being placed laterally with respect to the first two, without superposition, the toothing of the third barrel meshing with that of the other two barrels.

CH Patent Application No 694411A5 in the name of PARMIGIANI discloses a power reserve indicator device including a star wheel held in position by a jumper and integral with a display means, for watches with a double barrel, having manual winding or self-winding. A first winding barrel includes a winding pin actuating a winding lever driving the star wheel in a first direction of rotation, and a second letting-down barrel which includes a letting-down pin actuating a letting-down lever driving the star wheel in a second direction opposite to the first.

SUMMARY OF THE INVENTION

The invention proposes to provide a reliable and compact display mechanism for the power reserve of a train of energy accumulators, requiring less volume than a differential mechanism having separate inputs with intermediate gear trains.

To this end, the invention concerns a timepiece power reserve indicator.

The invention also concerns a timepiece movement including at least one such power reserve indicator.

The invention also concerns a timepiece including at least one such power reserve indicator

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
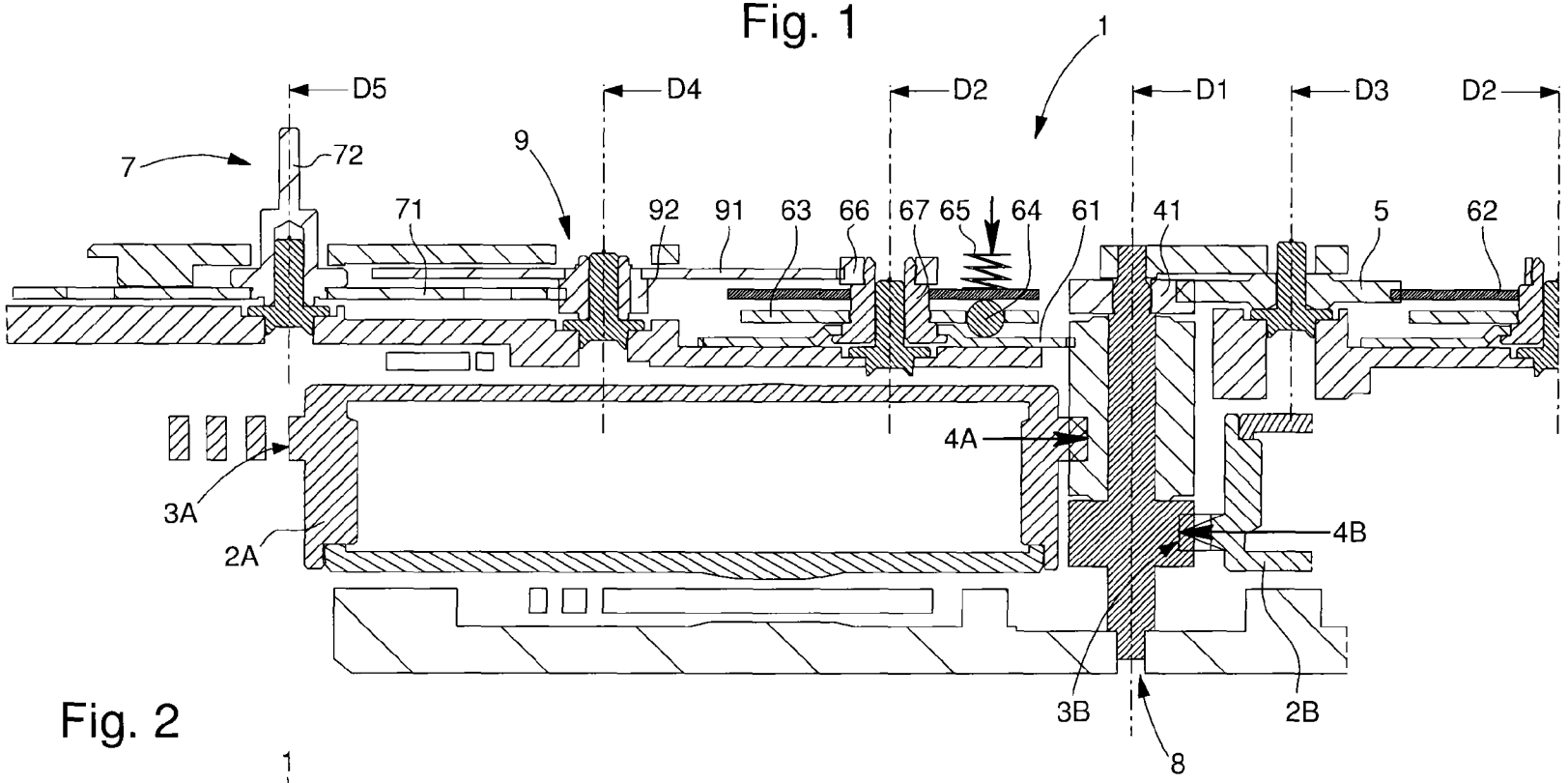
FIG. 1 shows a schematic cross-section passing through the various pivot axes, of one portion of a timepiece mechanism including a power reserve indicator according to the invention, arranged for the display of the power reserve indication of two different barrels, by means of a differential mechanism, whose axis is shown in double to illustrate separately the direct or indirect cooperation thereof with each of these barrels.
Figure 2:
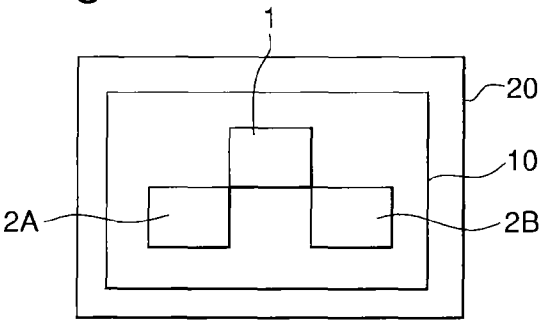
FIG. 2 is a block diagram showing a timepiece, notably a watch, including a movement equipped with such a power reserve indicator displaying the power reserve of two barrels.

The invention proposes to provide a reliable and compact mechanism for the display of the power reserve of an energy accumulator train, requiring less volume than a differential having separate inputs with intermediate gear trains.

The use of a differential mechanism is a good solution for such a display, however, its volume must be minimised, due the already very large volume occupied by the plurality of energy accumulators within the timepiece movement.

The invention is described and illustrated here with the non-limiting example of a movement including two ordinary barrels. Other accumulators may be used, the number of accumulators is not limited, since the state of the first and last accumulators is compared.

Thus, the invention concerns a timepiece power reserve indicator 1 for the display of the power reserve indication of a plurality of energy accumulators 2.

Power reserve indicator 1 includes a differential mechanism 6. Energy accumulators 2 each include one indicator 3 as output of this accumulator, which cooperates with one accumulator input 4 of a differential mechanism 6. One output 66 of this differential mechanism 6 cooperates with a mechanism 7 for the of the total power reserve of the plurality of energy accumulators 2.

According to the invention, at least two of these inputs 4 are coaxial.

In a particular embodiment, all of inputs 4 are coaxial.

In a particular embodiment, several of energy accumulators 2 are disposed in series with each other. More specifically, they are all disposed in series with each other.

In a specific embodiment, several of these energy accumulators 2 are disposed in parallel to each other.

In a specific embodiment, at least one energy accumulator 2 is a barrel.

In a specific embodiment as illustrated in FIG. 1, all of energy accumulators 2 are barrels.

The invention also concerns a timepiece movement 10 including at least one such power reserve indicator 1.

The invention also concerns a timepiece 20, particularly a watch, including at least one such power reserve indicator 1 and/or one such movement 10. It is understood that the power reserve indicator may concern both a movement and an additional function, such as a striking mechanism or similar, having its own energy accumulators.

More particularly the timepiece power reserve indicator 1 is arranged for the display of the power reserve indication of a plurality of energy accumulators 2 including a first barrel 2A and a second barrel 2B each including respectively a first output 3A and a second output 3B respectively cooperating with a first accumulator input 4A and a second accumulator input 4B of a dual transmission drive train leading to two differential inputs 61, 62 of a differential mechanism 6 comprised in the power reserve indicator 1.

These two differential inputs 61, 62 are formed respectively by a first input plate 61 and by a second input plate 62. And an output wheel 66 of the differential mechanism 6 cooperates with a mechanism 7 for the display of the total power reserve of the plurality of energy accumulators 2.

According to the invention, the first accumulator input 4A and the second accumulator input 4B are part of the same first input wheel set 8 of the differential mechanism 6, which is a ball bearing differential, and are coaxial about the same first axis D1 and are pivotally movable about the first axis D1 independently of each other.

And the first accumulator input 4A meshes with the first input plate 61 pivoting about a second pivot axis D2, the second accumulator input 4B pivots integrally with an output wheel 41 which meshes with an intermediate wheel 5 pivoting about a third pivot axis D2 driving the second input plate 62 of the differential 6, also pivoting about the second pivot axis D2.

The differential 6 includes, pivoting about the second pivot axis D2, a hub 67 driving both the output wheel 66 and a carrier plate 63 which carries one or more ball bearings 64 in contact with both the first input plate 61 and the second input plate 62, both mounted for free rotation on the hub 67, under the action of friction imparted by one or more springs 65.

FIG. 1 illustrates such a power reserve indicator 1 for two barrels 2A and 2B. Output 3A of first barrel 2A cooperates with a first accumulator input 4A of a first input wheel set 8 of differential 6, this first accumulator input 4A is pivotally movable about a first axis D1. Output 3B of second barrel 2B cooperates with a second accumulator input 4B of first input wheel set 8 and second accumulator input 4B is also pivotally movable about the same first axis D1, independently of first accumulator input 4A with which it is coaxial.

First accumulator input 4A meshes with a first input plate 61 of differential 6, pivoting about a second pivot axis D2.

The second accumulator input 4B pivots integrally with an output wheel 41 which meshes with an intermediate wheel 5 pivoting about a third pivot axis D3 and which engages with a second input plate 62 of differential 6 pivoting about second pivot axis D2.

Differential 6 includes, in a conventional manner, pivoting about second pivot axis D2, a hub 67 driving a carrier plate 63 which carries one or more ball bearings 64 in contact both with the first input plate 61 and second input plate 62, which are mounted for free rotation on hub 67, under the action of friction imparted by one or more springs 65. Hub 67 is also integral with an output 66 in the form of a wheel which meshes with an intermediate plate 91 comprised in a second input wheel set 9 pivoting about a fourth pivot axis D4, plate 91 being coaxial and pivoting integrally with a pinion 92 which engages with an input plate 71 of a power reserve display mechanism 7 which is coaxial and pivots integrally with an arbor 72 arranged to carry a display element, such as a hand, plate or similar.

The invention provides a considerable space saving inside the timepiece movement, as the mechanism according to the invention is much more compact than a differential with separate inputs.

The saving achieved during manufacture and assembly is substantial: only one pivot arrangement in the blanks, and therefore fewer machining operations, fewer jewel holes to be filled, greater ease of assembly and easier control of sideshake.

What is claimed is:

1. A timepiece power reserve indicator for the display of the power reserve indication of a plurality of energy accumulators, comprising:

a first barrel and a second barrel each including respectively a first output and a second output respectively cooperating with a first accumulator input and a second accumulator input of a dual transmission drive train leading to two differential inputs of a differential mechanism comprised in said power reserve indicator, said two differential inputs being formed respectively by a first input plate and by a second input plate, wherein an output of said differential mechanism cooperates with a mechanism for the display of the total power reserve of said plurality of energy accumulators, wherein said first accumulator input and said second accumulator input are part of the same first input wheel set of said differential mechanism, which is a ball bearing differential, and are coaxial about a same first axis and are pivotally movable about said first axis independently of each other, wherein said first accumulator input meshes directly with said first input plate pivoting about a second pivot axis, the first axis being spaced apart from the second pivot axis in a transverse direction, and wherein said second accumulator input pivots integrally with an output wheel which meshes with an intermediate wheel pivoting about a third pivot axis driving said second input plate of said differential, also pivoting about said second pivot axis, said differential including, pivoting about said second pivot axis, a hub driving both said output wheel and a carrier plate which carries one or more ball bearings in contact with both said first input plate and said second input plate, both mounted for free rotation on said hub, under the action of friction imparted by one or more springs.

2. The power reserve indicator according to claim 1, wherein said output wheel integral with said huh meshes with an intermediate plate comprised in a second input wheel set pivoting about a fourth pivot axis, said intermediate plate being coaxial and pivoting integrally with a pinion which engages with an input plate of said display mechanism which is coaxial and pivots integrally with an arbor arranged to carry a display element, or a hand, or a plate.

3. A timepiece movement, comprising:

at least one said power reserve indicator according to claim 1.

4. A timepiece, comprising:

at least one said power reserve indicator according to claim 1.

5. The power reserve indicator according to claim 1, wherein the first input plate and the second input plate are spaced apart from the output wheel along the second pivot axis such that the first input plate and the second input plate do not directly contact the output wheel.

6. The power reserve indicator according to claim 1, wherein the third pivot axis is spaced apart from the first axis and the second pivot axis in the transverse direction.

* * * * *